United States Patent [19]

Green

[11] 4,080,109

[45] Mar. 21, 1978

[54] FUEL INJECTION PUMPING APPARATUS

[75] Inventor: Alan Conway Green, Reading, England

[73] Assignee: Lucas Industries Limited, Birmingham, England

[21] Appl. No.: 698,874

[22] Filed: Jun. 23, 1976

[30] Foreign Application Priority Data

Jul. 5, 1975 United Kingdom ..... 28433/75

[51] Int. Cl.[2] ..... F04B 3/00

[52] U.S. Cl. ..... 417/251; 123/139 AQ; 417/221

[58] Field of Search ..... 123/139 AQ, 139 AP, 123/139 AR, 139 AD, 139 AE, 139 AL, 139 AM, 139 AS; 417/219, 221, 251, 252, 462

[56] References Cited

U.S. PATENT DOCUMENTS 2,916,029 12/1959 Kemp ..... 123/139 AQ 3,439,624 4/1969 Glikin et al. ..... 123/139 AE X 3,552,366 1/1951 Kemp ..... 123/139 AQ

FOREIGN PATENT DOCUMENTS 978,116 12/1964 United Kingdom ..... 417/252

*Primary Examiner*—Charles J. Myhre

*Assistant Examiner*—Tony M. Argenbright

[57] ABSTRACT

A fuel injection pumping apparatus includes an injection pump to which fuel is supplied from a feed pump under the control of throttle means. A component of the injection pump is adjustable by the application of fluid pressure to a piston. The fluid pressure is derived by way of a fixed orifice the downstream of which is connected to a cylinder containing the piston, the downstream side of the orifice being connected to a drain by way of a second fixed orifice and a variable orifice is provided which is adjustable with the throttle means and which determines the pressure applied to the piston.

2 Claims, 4 Drawing Figures

FUEL INJECTION PUMPING APPARATUS

This invention relates to fuel injection pumping apparatus for supplying fuel to internal combustion engines and of the kind comprising an injection pump for delivering fuel in timed relationship to an associated engine, a feed pump for supplying a fuel to the injection pump during the filling periods thereof, throttle means for adjusting the amount of fuel supplied by the feed pump to the injection pump and fluid pressure operable means for adjusting a component of the injection pump to vary the timing of injection of fuel to the associated engine.

The object of the present invention is to provide an apparatus of the kind specified in a simple and convenient form and in which adjustment of the timing of injection can be obtained for varying settings of the throttle means.

According to the invention an apparatus of the kind specified comprises valve means operable to provide a fluid pressure which increases as the speed of operation of the apparatus increases, a first fixed orifice through which said fluid pressure is applied to said fluid pressure operable means, a second fixed orifice and through which fluid from the downstream side of said first fixed orifice can flow to a drain and a variable orifice operable to vary the pressure applied to said fluid pressure operable means, the size of said variable orifice being determined by the setting of said throttle means.

According to a further feature of the invention said variable orifice is disposed in series with second fixed orifice, the degree of restriction imposed by said variable orifice increasing as the quantity of fuel supplied to the injection pump decreases.

According to a still further feature of the invention said variable orifice is connected in parallel with said first fixed orifice, the degree of restriction imposed by said variable orifice decreasing as the quantity of fuel supplied to the injection pump decreases.

Figure 1:
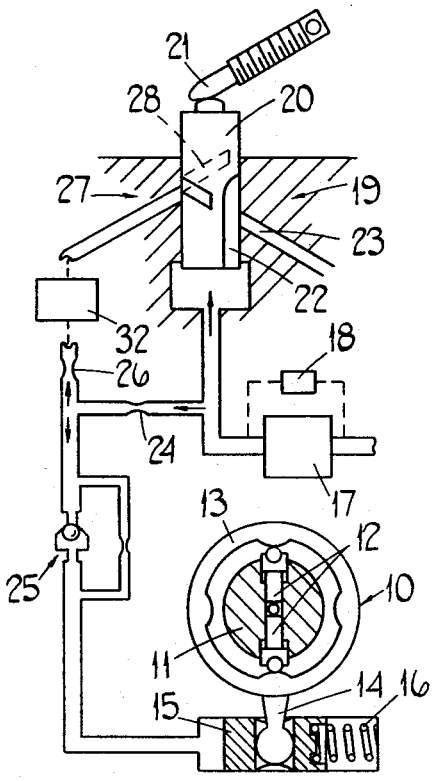
Figure 2:
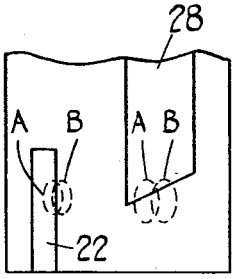
Figure 3:
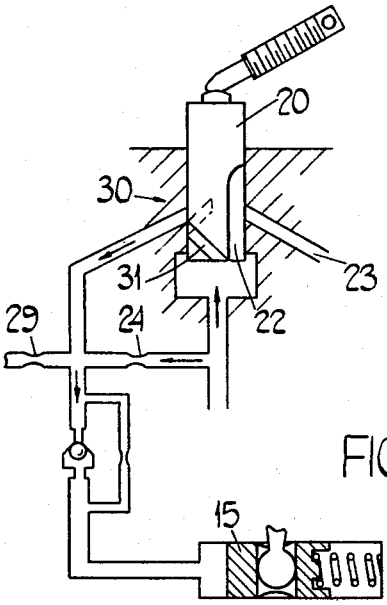
Figure 4:
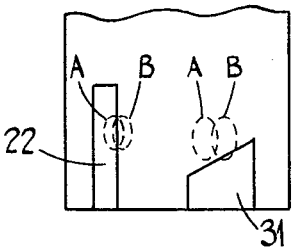

Two examples of apparatus in accordance with the invention will now be described with reference to the accompanying drawings, in which, FIG. 1 is a diagrammatic representation of the first example of the apparatus, FIG. 2 is a diagrammatic developed view of a portion of the apparatus of FIG. 1, FIG. 3 is a view similar to FIG. 1 of the other example of the apparatus and, FIG. 4 is a view corresponding to FIG. 2, of the apparatus shown in FIG. 3.

With reference to FIG. 1 of the drawings the pumping apparatus comprises an injection pump generally indicated at 10 but including a rotary distributor member 11 which is housed within a body part not shown of the apparatus, the distributor member being adapted to be driven in timed relationship with the associated engine. Formed in the distributor member is a transversely extending bore which accomodates a pair of pumping plungers 12 which are moved inwardly as the distributor member rotates, by the cooperation of rollers at the outer ends of the plungers, engaging with the internal periphery of an annular cam ring 13 having formed on its internal periphery, pairs of inwardly extending cam lobes.

The fuel displaced by the injection pump during the injection strokes thereof is distributed in known manner, to injection nozzles associated with the combustion chambers of the associated engine.

The cam ring 13 is angularly adjustable in order to determine the timing of injection of fuel to the associated engine and for this purpose the cam ring is provided with a peg 14 which is engaged within a recess defined in a fluid pressure operable piston 15 which constitutes the aforesaid fluid pressure operable means. The piston is spring loaded by means of a spring 16 towards one end of the cylinder in which it is mounted. As the piston 15 moves under the action of the spring 16 the timing of injection of fuel is retarded.

The apparatus also includes a feed pump 17 conveniently having a rotary part which is mounted on the distributor member 11. The feed pump draws fuel from a convenient source not shown and the output pressure of the feed pump is controlled by valve means 18 so that as the speed of operation of the associated engine increases, the outlet pressure of the feed pump also increases.

The amount of fuel which is supplied by the injection pump at each injection stroke is determined by the amount of fuel which is supplied to it during the filling strokes, by the feed pump and the fuel flowing to the injection pump is controlled by a throttle means 19. In the particular example the throttle means comprises an angularly adjustable throttle member 20 mounted within the body part of the apparatus and its angular setting is determined in part by a mechanical governor which is responsive to the speed at which the apparatus is driven, and in part to the setting of an operator adjustable member. Conveniently the throttle member is housed within a bore formed in the body part but extends from the bore into contact with a stop member 21. The other end of the throttle member is subjected to the outlet pressure of the feed pump and formed in the throttle member is an axial groove 22 which registers to a varying degree, with a port 23 formed in the wall of the cylinder in which the throttle member is mounted. The port 23 by way of further ports and passages in the body part and distributor member, is brought into communication with the injection pump during the filling periods thereof. The angular setting therefore of the throttle member determines the amount of fuel which is supplied by the feed pump to the injection pump during the filling strokes thereof.

In order to adjust the timing of injection of fuel the piston 15 is subjected to a varying fluid pressure. The fluid pressure is derived from the outlet of the feed pump but is modified in accordance with the setting of the throttle member. The outlet of the feed pump communicates with the cylinder containing the piston 15 by way of a first fixed orifice 24 and the downstream side of this orifice is connected to the cylinder containing the piston by way of a valve 25 the purpose of which is to minimise so far as possible, movement of the piston by the reaction of the rollers with the cam lobes. A small bleed orifice is provided in parallel with the valve 25 to permit fuel to escape from the cylinder as the piston is moved by the spring 16. The downstream side of the orifice 24 also communicates with a drain by way of a second fixed orifice 26 connected in series with a variable orifice 27 which is constituted by a port in the wall of the cylinder in which the throttle member is mounted and by an inclined groove 28 formed in the periphery of the throttle member. It is arranged that as the throttle member is moved angularly to increase the amount of fuel supplied to the engine then the degree of restriction offered by the variable orifice 27 decreases so that an increased flow of fuel takes place through the fixed orifices 24 and 26 with the result that the pressure applied to the piston 15 is reduced. Referring to FIG. 2 the groove 22 and the groove 28 are shown diagrammatically as also are the associated ports. Moreover, it should be noted in FIG. 2 that rather than move the grooves to indicate angular movement of the throttle member, the ports have been moved. The dotted position of the ports referenced A indicates the position when the maximum amount of fuel is being supplied to the engine that is to say when the engine is operating at full load. It will be seen that the port associated with the groove 28 is approximately half covered but is uncovered as the throttle member is moved to reduce the amount of fuel supplied to the engine. Therefore the pressure applied to the piston 15 increases as the amount of fuel supplied to the engine decreases. Conveniently, the degree of restriction offered by the variable orifice 27 is less than that offered by the fixed orifice 26 when the apparatus is delivering the maximum amount of fuel.

The stop 21 is adjustable to enable an adjustment to be provided of the degree of advance obtained at low loads independently of the degree of advance obtained at full load. It will be appreciated that the positions of the orifices 26 and 27 can be reversed. When the output pressure of the feed pump 17 is low as when the engine is being started, there would be an undesirable loss of fuel through the groove 28. This is avoided by providing a pressurizing valve 32 intermediate the orifice 26 and the variable orifice constituted by the groove 28.

In the arrangement shown in FIG. 3 in which the same reference numerals are utilised wherever possible, the first fixed orifice 24 is positioned in exactly the same way as the corresponding orifice of the example of FIG. 1. The second fixed orifice 29 connects the downstream side of the first fixed orifice 24 directly with a drain and the variable orifice 30 is connected in parallel with the fixed orifice 24. This is achieved by arranging that the inclined groove 31 communicates not with a drain but with the outlet of the feed pump. This difference is demonstrated in FIG. 3 and also FIG. 4. The arrangement is such that as the throttle member 20 is moved to increase the amount of fuel supplied to the engine, the degree of restriction offered by the variable orifice decreases so that the pressure which is applied to the piston 15 also decreases. The variable orifice 30 is arranged to be completely closed at full load. The pressure at full load is therefore dependent upon the relative sizes of the fixed orifices 24 and 29 and the outlet pressure of the feed pump. Again, an adjustable stop is provided for the throttle member to effect final adjustment of the degree of advance obtained at low engine loads independently of the advance obtained at full load.

As with the example of FIG. 1 a pressurizing valve (not shown) may be provided downstream of the fixed orifice 29 to prevent loss of fuel through this orifice when the outlet pressure of the feed pump is low.

It will be understood that other forms of throttle means may be provided and that an hydraulic governor mechanism rather than a mechanical governor mechanism used to determine the setting of the adjustable throttle member.

I claim:

1. A fuel injection pumping apparatus comprising an injection pump, a feed pump for supplying fuel to said injection pump, throttle means for controlling the supply of fuel from said feed pump to said injection pump, valve means operable to provide a fluid pressure which increases as the speed of operation of the apparatus increases, fluid pressure operable means to vary the timing of injection of fuel by said injection pump, a first fixed orifice through which said fluid pressure is applied to said fluid pressure operable means, a second fixed orifice and through which fluid from the downstream side of said first fixed orifice can flow to a drain, and a variable orifice disposed in series with said second fixed orifice operable to vary the pressure applied to said fluid pressure operable means, the degree of restriction imposed by said variable orifice increasing as the quantity of fuel supplied to the injection pump decreases, said variable orifice being adjustable with said throttle means and the size of said variable orifice being determined by the setting of said throttle means, said throttle means comprising a cylinder, an axially movable and angularly adjustable member located within the cylinder, one end of said member being subjected to the outlet pressure of the feed pump at one end of the cylinder, a stop to limit the axial movement of the member, said variable orifice being constituted by a port in the wall of said cylinder and a helical groove registering with said port, said groove communicating with a drain, the cylinder having a further port, and the member having an axial groove communicating with said one end of the cylinder, the extent of registration of said further port and said axial groove being determined by the angular setting of said member thereby to determine the amount of fuel supplied to the injection pump, said stop being adjustable so as to determine the effective size of said variable orifice for a given angular setting of the member.

2. A fuel injection pumping apparatus comprising an injection pump, a feed pump for supplying fuel to said injection pump, throttle means for controlling the supply of fuel from said feed pump to said injection pump, valve means operable to provide a fluid pressure which increases as the speed of operation of the apparatus increases, fluid pressure operable means to vary the timing of injection of fuel by said injection pump, a first fixed orifice through which said fluid pressure is applied to said fluid pressure operable means, a second fixed orifice and through which fluid from the downstream side of said first fixed orifice can flow to a drain, and a variable orifice connected in parallel with said first fixed orifice operable to vary the pressure applied to said fluid pressure operable means, the degree of restriction imposed by said variable orifice decreasing as the quantity of fuel supplied to the injection pump decreases, said variable orifice being adjustable with said throttle means and the size of said variable orifice being determined by the setting of said throttle means, said throttle means comprising a cylinder, an axially movable and angularly adjustable member located within the cylinder, one end of said member being subjected to the outlet pressure of the feed pump at one end of the cylinder, a stop to limit the axial movement of the member, said variable orifice being constituted by a port in the wall of said cylinder and a helical groove registering with said port, said groove extending from said one end of the member, the cylinder having a further port and the member having an axial groove communicating with said one end of the cylinder, the extent of registration of said further port and said axial groove being determined by the angular setting of said member thereby to determine the amount of fuel supplied to the injection pump, said stop being adjustable so as to determine the effective size of said variable orifice for a given angular setting of the member.

* * * * *